US007648391B2

(12) United States Patent
Nishimura et al.

(10) Patent No.: US 7,648,391 B2
(45) Date of Patent: Jan. 19, 2010

(54) SHAFT LOCK SOCKET SYSTEM

(75) Inventors: Yoji Nishimura, Tokyo (JP); Frank Yoo, Tokyo (JP)

(73) Assignee: Furutech Co., Ltd., Tokyo (JP)

( * ) Notice: Subject to any disclaimer, the term of this patent is extended or adjusted under 35 U.S.C. 154(b) by 289 days.

(21) Appl. No.: 11/468,355

(22) Filed: Aug. 30, 2006

(65) Prior Publication Data

US 2007/0092353 A1 Apr. 26, 2007

(30) Foreign Application Priority Data

Sep. 23, 2005 (TW) ..... 94132950 A

(51) Int. Cl.
*H01R 13/73* (2006.01)

(52) U.S. Cl. ..... 439/564

(58) Field of Classification Search ..... 439/346, 439/564, 783, 807, 833, 863, 70, 936, 55, 439/68, 71–73, 201
See application file for complete search history.

(56) References Cited

U.S. PATENT DOCUMENTS 5,252,079 A * 10/1993 Grabbe ..... 439/70
6,918,780 B1 * 7/2005 Yang ..... 439/346
2001/0034153 A1 * 10/2001 McIntosh et al. ..... 439/364

* cited by examiner

*Primary Examiner*—Edwin A. Leon

(57) ABSTRACT

A shaft lock socket system comprises: a housing defining a receiving chamber; at least a socket received in the receiving chamber, installed with a gap between the back of the socket and the inward portion of the receiving chamber; and at least an adjusting member arranged in the gap between the socket and the receiving chamber and abutting against the back of the socket. The system allows for adjustment of the tightness between the socket and the housing to a proper level, reducing resonance vibration in response to tiny vibrations caused by current passing through the plug and socket, thus improving the stability of power transmission and the sound quality of an audio device.

7 Claims, 4 Drawing Sheets

SHAFT LOCK SOCKET SYSTEM

FIELD OF THE INVENTION

The present invention relates to a shaft lock socket system, and more specifically, to a shaft lock socket system improving power transmission stability.

BACKGROUND OF THE INVENTION

In recently years, in the field of audio devices, the effect of power quality to sound quality has received attention in many aspects.

As shown in FIG. 4 (PRIOR ART), a conventional power socket 2 used in an audio device comprises a housing 50 and a plurality of sockets 60. The housing 50 defines a receiving chamber 51. Also, the housing 50 has protruding portions 52 extending from the sides of the open portion of the receiving chamber 51. The protruding portions 52 define a plurality of screw holes (not shown).

Each of two sides of the socket 60 comprises a flange portion 61. The flange portion 61 defines a plurality of screw holes (not shown). The positions of the screw holes of the flange portion 61 correspond to the screw holes of the protruding portion 52. Screws (not shown) are employed to secure the flange portions 61 of the socket 60 to the protruding portions 52 of the housing 50, the socket 60 being held in the receiving chamber 51 such that there is a gap between the socket 60 and the inward portion of the receiving chamber 51 of the housing 50.

When the socket is engaged with a plug of an audio device, there is a gap between the plug and the inward portion of the receiving chamber of the housing. The plug is thus received in the socket that is attached to the receiving chamber in a suspended manner. When tiny vibrations are generated because of current passing through the plug and socket, the socket is thus affected, leading to unstable power transmission, and further affecting the sound quality of the audio device.

Consequently, it is desirable to devise a way to avoid the tiny vibrations generated due to current passing through the plug and socket when the plug of an audio device is engaged with the socket, adversely affecting the stability of power transmission and the sound quality of the audio device.

SUMMARY OF THE INVENTION

In light of the drawbacks of the above-mentioned conventional technologies, an objective of the present invention is to provide a shaft lock socket system for reducing resonance of the socket so as to achieve power transmission stability.

In accordance with the above and other objectives, the present invention proposes a shaft lock socket system comprising: a housing defining a receiving chamber; at least a socket received in the receiving chamber, installed with a gap between the back of the socket and the inward portion of the receiving chamber; and at least an adjusting member arranged in the gap between the back of the socket and the inward portion of the receiving chamber and abutting against the back of the socket, for adjusting the tightness between the socket and the housing to a proper level, reducing the generation of small vibrations within the socket.

The housing is preferably made of aluminum material, for keeping the shaft lock socket system away from the interference of electromagnetic noise signals.

The inward portion of the receiving chamber of the housing defines at least a screw hole. The adjusting member is a conical screw. The conical screw is locked into the screw hole of the inward portion of the receiving chamber so that the conical screw abuts against the back portion of the socket, for adjusting the tightness between the socket and the housing to a proper level, reducing the generation of small vibrations within the socket.

In a second embodiment, the present invention proposes a shaft lock socket system comprising: a housing defining a receiving chamber; at least a socket received in the receiving chamber, installed with a gap between the back of the socket and the inward portion of the receiving chamber; and at least a supporting member secured to the inward portion of the receiving chamber and abutting against the back portion of the socket, for achieving a proper tightness level between the socket and the housing, reducing the generation of small vibrations within the socket.

Again, the housing is preferably made of aluminum material, for keeping the shaft lock socket system away from the interference of electromagnetic noise signals.

The supporting member is cylindrical.

Ordinarily, when the plug of an audio device is inserted into a socket, tiny vibration is generated because current passes through the plug and socket, which causes resonance in the socket. However, by adjusting the adjusting member of the shaft lock system of the invention to a proper tightness level, or by the supporting member abutting against the back of the socket, the generation of such vibration is reduced, and the stability of the power transmission is increased and the sound quality of the audio device is improved.

The following embodiments are used to describe the present invention; those skilled in the art can easily understand other advantages and functions of the present invention via the contents disclosed in the description. Various embodiments can be employed in the present invention; and the details of the description can be employed from various points of view and yet still fall within the scope of the invention.

DETAILED DESCRIPTION OF THE PREFERRED EMBODIMENTS

The following embodiments further detail the technical solution of the present invention, however, such details shall not be regarded as limitations to the scope of the present invention.

Figure 1:
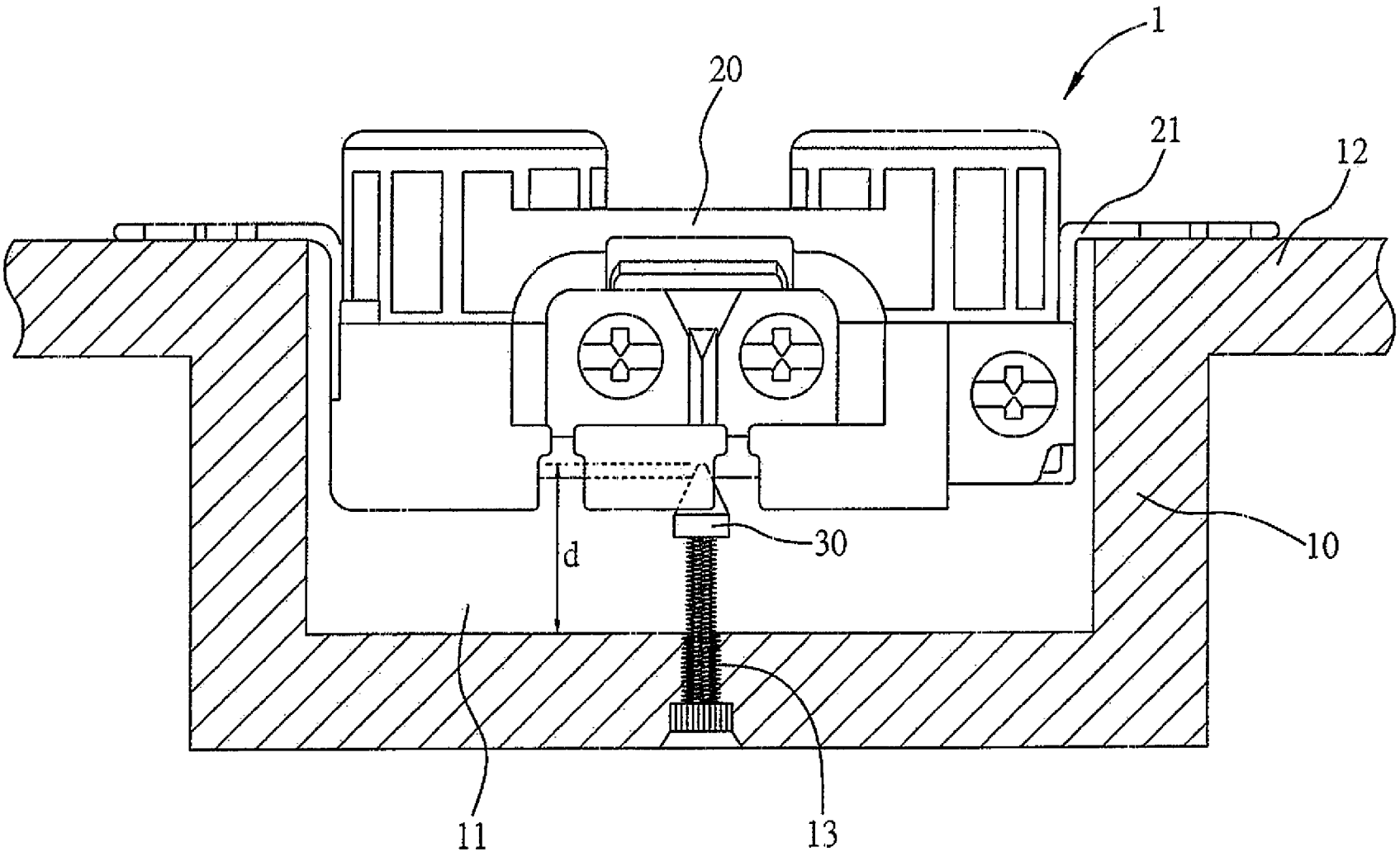
FIG. 1 is a cross-sectional view of the shaft lock socket system in accordance with a first embodiment of the present invention.

Referring to FIG. 1, a cross-sectional view of the first embodiment of the shaft lock socket system of the present invention is shown. The shaft lock socket system 1 is employed in an audio device such as a sound system or a media player, the shaft lock system mainly comprising a housing 10, a plurality of sockets 20, and a plurality of adjusting members 30 (only a single socket and one adjusting member are illustrated in the figure).

The housing 10 defines a receiving chamber 11. Protruding portions 52 extend from sides of the open portion of the receiving chamber 51. The protruding portions 12 define a plurality of screw holes (not shown), and the inward portion of the receiving chamber 11 defines a plurality of screw holes 13.

Each of two sides of the socket 20 comprises a flange portion 21. The flange portions 21 define a plurality of screw holes (not shown). The positions of the screw holes of the flange portions 12 correspond to the positions of the screw holes of the protruding portions 12. A screw (not shown) is employed to secure the flange portions 21 of the socket 20 to the protruding portions 12 of the housing 10, such that there is a gap of distance d between the back of the socket 20 and the inward portion of the receiving chamber 11 of the housing 10.

Figure 2:
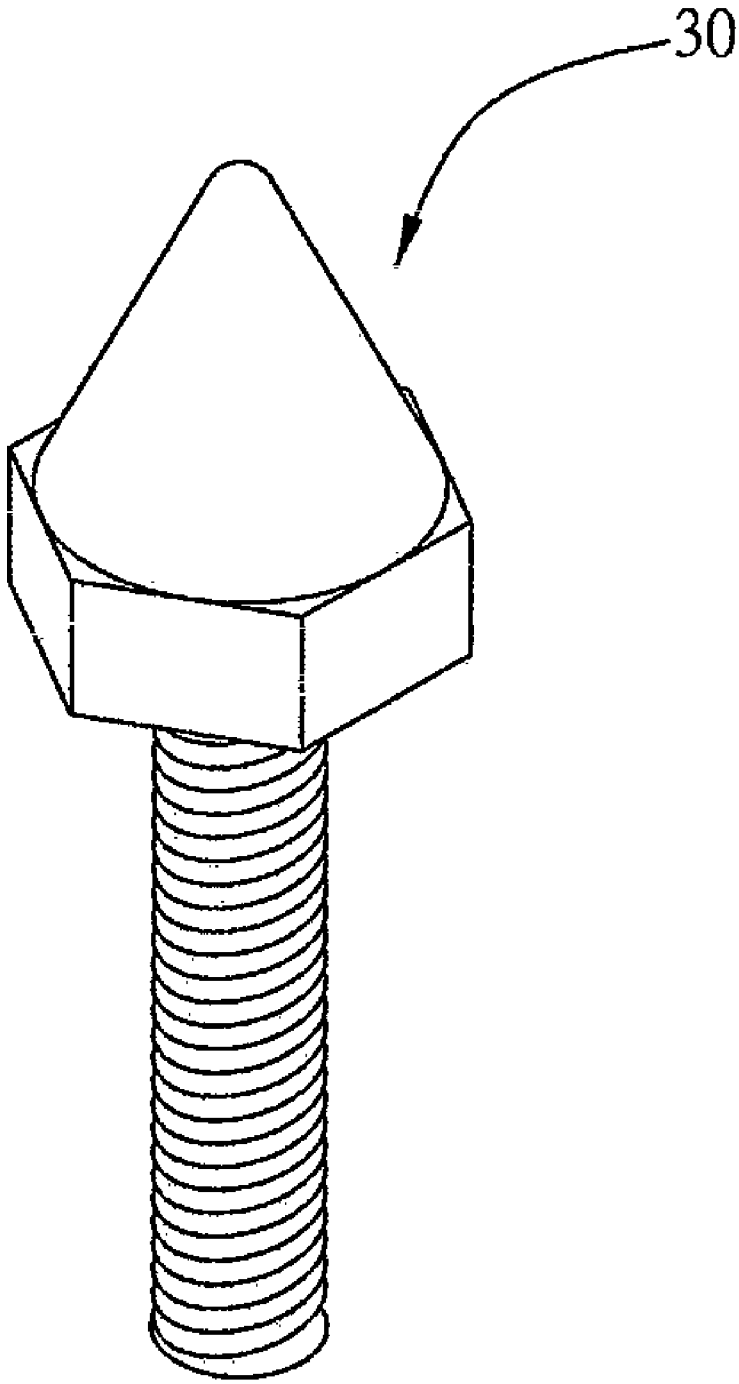
FIG. 2 is an isometric view of an adjusting member in accordance with the first embodiment of the present invention.

Referring to FIG. 1 and FIG. 2 (showing an isometric view of an adjusting member of the shaft lock socket system of the present invention), the adjusting member 30 is a conical screw, which is locked into the screw hole 13 of the bottom portion of the receiving chamber 11. The adjusting member 30 is thus arranged in the distance d between the back of the socket 20 and the inward portion of the receiving chamber 11, and abutted against the back of the socket 20. The tension applied by the adjusting member 30 to the socket 20 from the housing 10 can be varied because the tiny vibrations generated by current passing through the socket 20 can differ depending on the audio devices connected. Accordingly, the build-up of resonance vibration within the socket 20 is reduced, and the stability of power transmission is improved, with a corresponding improvement in the sound quality of the audio device.

Furthermore, the housing 10 is made of aluminum material, thus the shaft lock socket system 1 is free from interference of electromagnetic noise signals.

Figure 3:
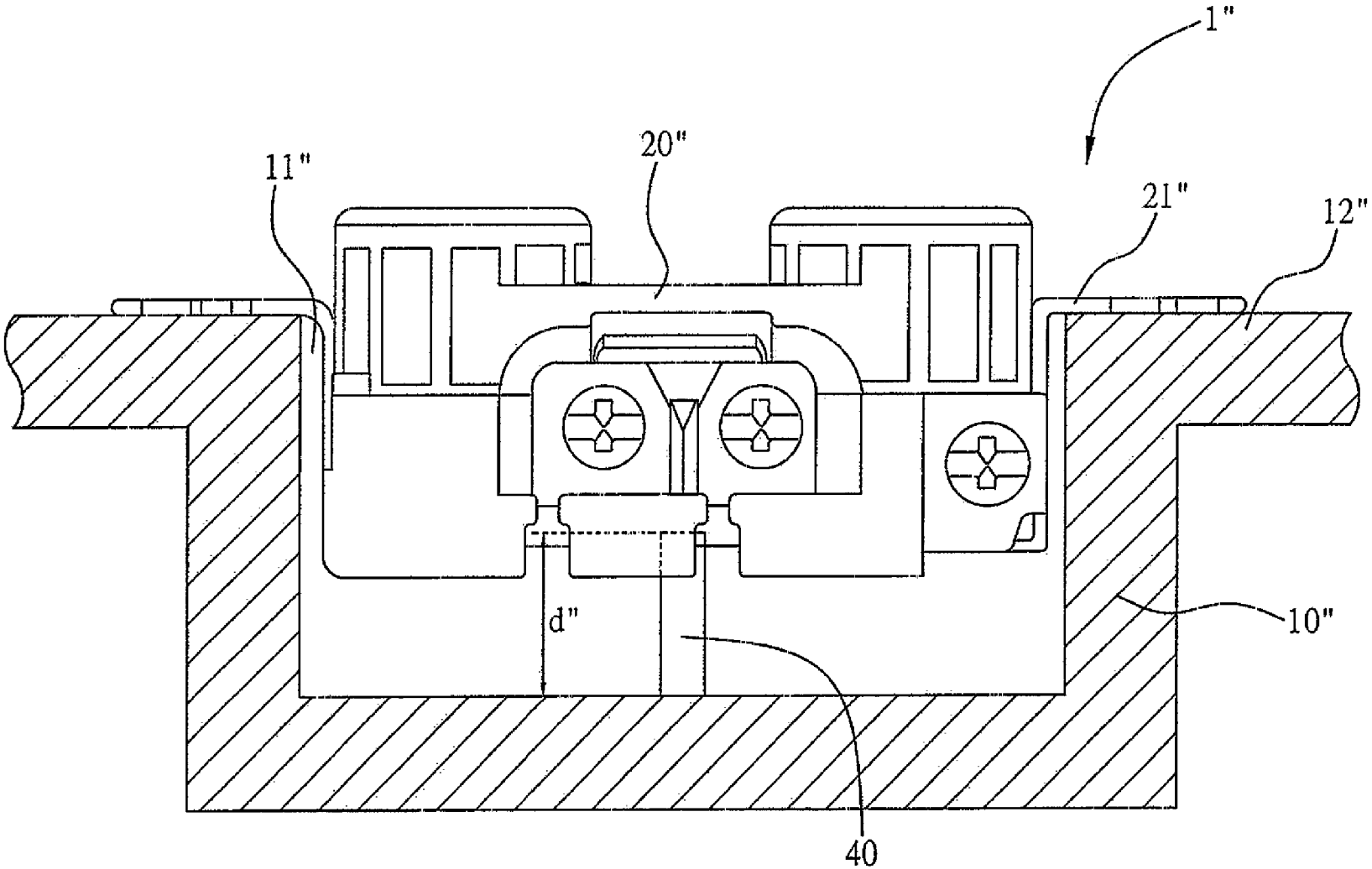
FIG. 3 is a cross-sectional view of the shaft lock socket system in accordance with a second embodiment of the present invention.
Figure 4:
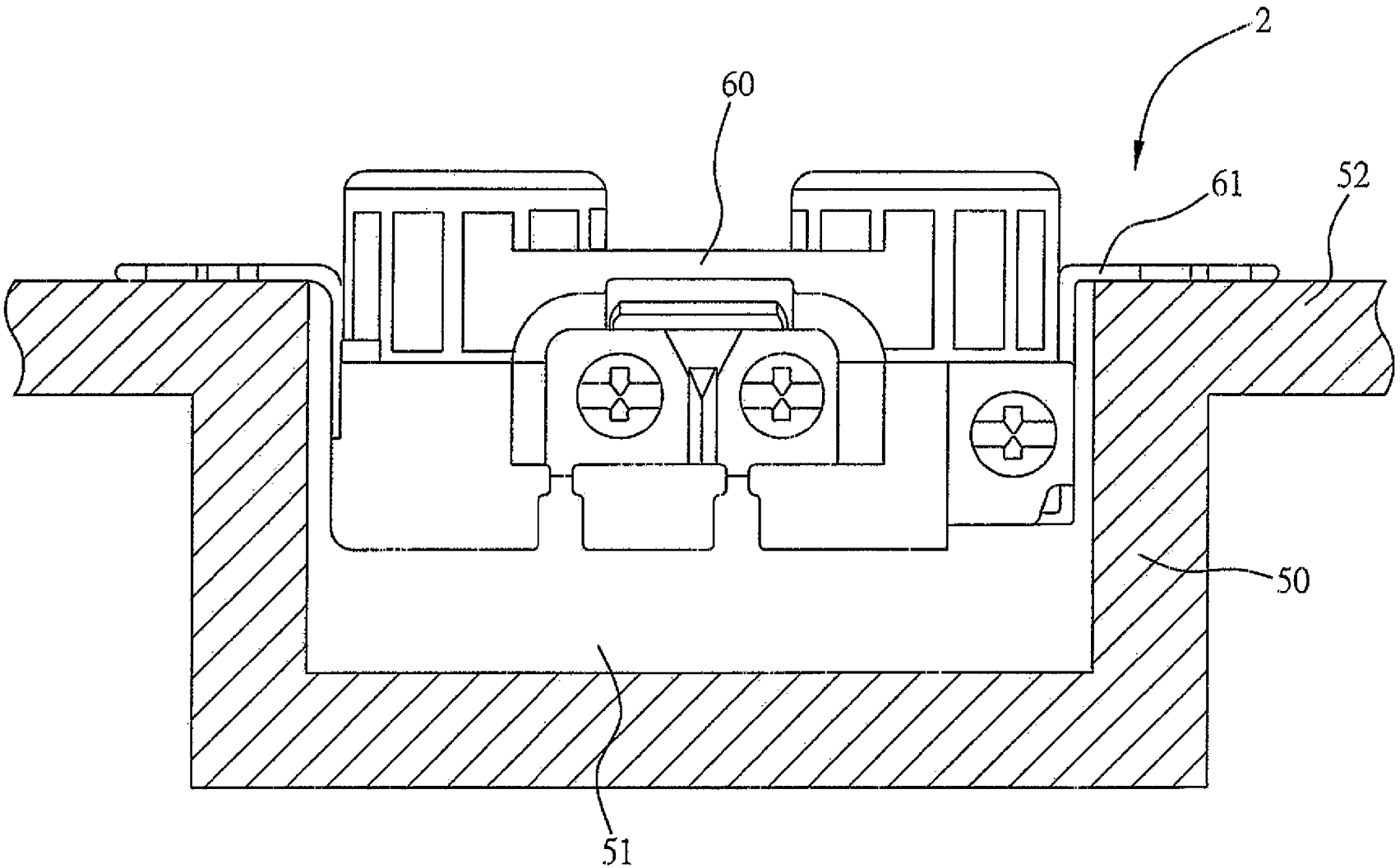
FIG. 4 (PRIOR ART)
FIG. 4 (PRIOR ART) is a cross-sectional view of a conventional power socket.

Referring to FIG. 3, a cross-sectional view of the shaft lock socket system in accordance with a second embodiment of the present invention is shown. The shaft lock socket system 1" of the second embodiment is similar to that of the first embodiment, the difference being that the inward portion of the receiving chamber 11" of the housing 10" comprises at least a supporting member 40. The supporting member 40 is cylindrical, and arranged between the back of the socket 20" and the inward portion of the receiving chamber 11" for abutting against the back portion of the socket 20". The length of the supporting member 40 is equal to the length of distance d" between the back of the socket 20" and the inward portion of the receiving chamber 11". Thus, when a plug of an audio device is engaged with the socket 20", and tiny vibration is generated due to current passing through the socket 20", the socket 20" does not allow the formation of resonance vibration because the supporting member 40 abuts against the back of the socket 20". Thus, the power transmission stability is not affected, and the sound quality of the audio device is improved. It is to be noted that, for achieving a more pleasant appearance, the housing 10" further comprises a cover arranged on the front of the housing 10", and defines a through hole corresponding to the socket 20", which can be understood by those skilled in the art and will not be detailed via figures and description.

Consequently, when the shaft lock socket system engages the socket with the plug of the audio device, potential resonance in response to tiny vibrations generated by current passing through the plug and socket is suppressed by tension applied by adjustment of the adjusting member to a proper tightness, or by the supporting member abutting against the bottom of the socket. Thus, the socket is not affected by the tiny vibration, and the stability of the power transmission is improved and the sound quality of the audio device is improved.

It should be apparent to those skilled in the art that the above description is only illustrative of specific embodiments and examples of the present invention. The present invention should therefore cover various modifications and variations made to the herein-described structure and operations of the present invention, provided they fall within the scope of the present invention as defined in the following appended claims.

What is claimed is:

1. A shaft lock socket system comprising:

a housing defining a receiving chamber;

at least a power socket received in the receiving chamber, the power socket being installed with a gap between the back surface of the power socket and the inward portion of the receiving chamber; and at least an adjusting member arranged in the gap formed by the back surface of the power socket and the inward portion of the receiving chamber and has a distal end to abut against the back surface of the power socket and another end to be in contact with the inward portion of the receiving chamber, for adjusting the tightness between the power socket and the housing to a proper level, in order to reduce resonance vibration within the power socket in response to small vibrations due to the flow of current, wherein a distance of the gap is equal to a length between the distal end and a surface of the inward portion of the receiving chamber associated with the gap.

2. The previously presented)The shaft lock socket system as claimed in claim 1, wherein the housing is made of aluminum material.

3. The shaft lock socket system as claimed in claim 1, wherein the inward portion of the receiving chamber of the housing defines at least a screw hole, and the adjusting member is a conical screw.

4. The shaft lock socket system as claimed in claim 3, wherein the conical screw is locked into the screw hole of the inward portion of the receiving chamber so that the conical screw abuts against the back portion of the socket, for adjusting the tightness between the socket and the housing to a proper level, thus reducing the generation of resonance vibration.

5. A shaft lock socket system comprising:

a housing defining a receiving chamber;

at least a power socket received in the receiving chamber, installed with a gap formed by the back surface of the power socket and the inward portion of the receiving chamber; and at least a supporting member secured to the inward portion of the receiving chamber and abutting against the back surface of the power socket, for achieving a proper tightness level between the power socket and the housing, in order to reduce the formation of resonance vibration within the power socket in response to smallvibrations due to the flow of current, wherein a distance of the gap is equal to a length of the supporting member.

6. The shaft lock socket system as claimed in claim 5, wherein the housing is made of aluminum material.

7. The shaft lock socket system as claimed in claim 6, wherein the supporting member is cylindrical.

* * * * *